US006222087B1

(12) United States Patent
Johnson et al.

(10) Patent No.: US 6,222,087 B1
(45) Date of Patent: Apr. 24, 2001

(54) CATALYTIC PRODUCTION OF LIGHT OLEFINS RICH IN PROPYLENE

(75) Inventors: David L. Johnson, Glen Mills, PA (US); Khushrav E. Nariman, Chantilly, VA (US); Robert A. Ware, Wyndmoor, PA (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/351,146

(22) Filed: Jul. 12, 1999

(51) Int. Cl.[7] ..... C07C 4/06; C10G 11/02

(52) U.S. Cl. ..... 585/651; 585/653; 585/649; 208/114; 208/120.01

(58) Field of Search ..... 585/653, 651, 585/649; 208/114, 120.01

(56) References Cited

U.S. PATENT DOCUMENTS

| | | | | |
|---|---|---|---|---|
| 3,911,041 | | 10/1975 | Kaeding et al. | 260/682 |
| 3,939,058 | | 2/1976 | Plank et al. | 208/120 |
| 3,972,832 | | 8/1976 | Butter et al. | 252/437 |
| 4,141,859 | | 2/1979 | Plank et al. | 252/455 |
| 4,171,257 | | 10/1979 | O'Rear et al. | 208/120 |
| 4,251,348 | | 2/1981 | O'Rear et al. | 208/61 |
| 4,282,085 | | 8/1981 | O'Rear et al. | 208/120 |
| 4,347,121 | | 8/1982 | Mayer et al. | 208/58 |
| 4,356,338 | * | 10/1982 | Young | 585/407 |
| 4,390,413 | | 6/1983 | O'Rear et al. | 208/61 |
| 4,423,266 | | 12/1983 | Young | 585/481 |
| 4,436,614 | | 3/1984 | Olbrich et al. | 208/89 |
| 4,502,945 | | 3/1985 | Olbrich et al. | 208/120 |
| 4,582,815 | | 4/1986 | Bowes | 502/64 |
| 4,590,321 | | 5/1986 | Chu | 585/415 |
| 4,918,256 | | 4/1990 | Nemet-Mavrodin | 585/415 |
| 4,980,053 | | 12/1990 | Li et al. | 208/120 |
| 5,019,664 | | 5/1991 | Del Rossi et al. | 585/419 |
| 5,026,936 | | 6/1991 | Leyshon et al. | 585/315 |
| 5,053,374 | | 10/1991 | Absil et al. | 502/64 |
| 5,171,921 | | 12/1992 | Gaffney et al. | 585/653 |
| 5,182,242 | | 1/1993 | Marler | 502/66 |
| 5,292,976 | | 3/1994 | Dessau et al. | 585/322 |
| 5,348,643 | | 9/1994 | Absil et al. | 208/114 |
| 5,380,690 | | 1/1995 | Zhicheng et al. | 502/65 |
| 5,389,232 | | 2/1995 | Adewuyi et al. | 208/120 |
| 5,456,821 | | 10/1995 | Absil et al. | 208/114 |
| 5,472,594 | | 12/1995 | Tsang et al. | 208/114 |
| 5,637,207 | | 6/1997 | Hsing et al. | 208/164 |
| 5,670,037 | | 9/1997 | Zaiting et al. | 208/114 |

FOREIGN PATENT DOCUMENTS

| | | | |
|---|---|---|---|
| 109060 | * | 5/1984 | (EP) . |
| 0 347 003 B1 | | 12/1989 | (EP) . |
| 0 372 632 B1 | | 6/1990 | (EP) . |
| 0 385 538 A1 | | 9/1990 | (EP) . |
| 0 385 538 B1 | | 9/1990 | (EP) . |
| 0 490 435 B1 | | 6/1992 | (EP) . |
| WO 98/03612 | | 1/1998 | (WO) . |

OTHER PUBLICATIONS

"The Paragon Process: A New Hydrocracking Concept", D. J. O'Rear, Ind. Eng Chem. Res. 26:2337–2344 (1987).
"Cracking of FC and Coker Naphthas by ZSM–5 Catalyst and Equilibrium FC Catalyst", Hsing et al. Symposium on Hydrogen Transfer in Hydrocarbon Processing, Div. Of Petroleum Chemistry Inc., 208th Meeting, Am. Chem. Soc. Washington, D.C., p. 388–392 (1994).
"Deep Catalytic Cracking Plant Produces Propylene in Thailand", Oil & Gas Journal, p. 49–53 (1998).
"Deep Catalytic Cracking, Maximize Olefin Production", Chapin et al, NRPA Annual Meeting, AM–94–43, Mar. 22–24, p.1–14 (1994).
"DCC Flexibility for Isoolefins Production ", Li et al., Symposium on Advances in Fluid Catalytic Cracking, Divisio of Petroleum Chemistry, Inc. 206th National Meeting, Am Chem Soc. Chicago, p. 581–583 (1993).
"DCC—A New Propylene Production Process from Vaccum Gas Oil", Zaiting et al., National Petroleum Refiners Association, AM–90–40, p. 1–14 (1990).
"Commercial Trail of DCC (Deep Catalytic Cracking) Process for Gaseous Olefins Production", Xieqing et al., Research Institute of Petroleum, SINOPEC (undated).
"Deep Catalytic Cracking for Light Olefins", Chapin et al., Presented at Fifth World Congress of Chemical Engineering San Deigo (1996).

* cited by examiner

*Primary Examiner*—Walter D. Griffin
*Assistant Examiner*—Thuan D. Dang

(57) ABSTRACT

A hydrocarbon feed containing $C_4$–$C_7$ olefins and/or paraffins is converted to light olefins, by contacting the feed with a catalyst containing ZSM-5 and/or ZSM-11, having an initial silica to alumina ratio greater than about 300:1, and phosphorus.

10 Claims, 1 Drawing Sheet

CATALYTIC PRODUCTION OF LIGHT OLEFINS RICH IN PROPYLENE

BACKGROUND OF THE INVENTION

Figure 1:
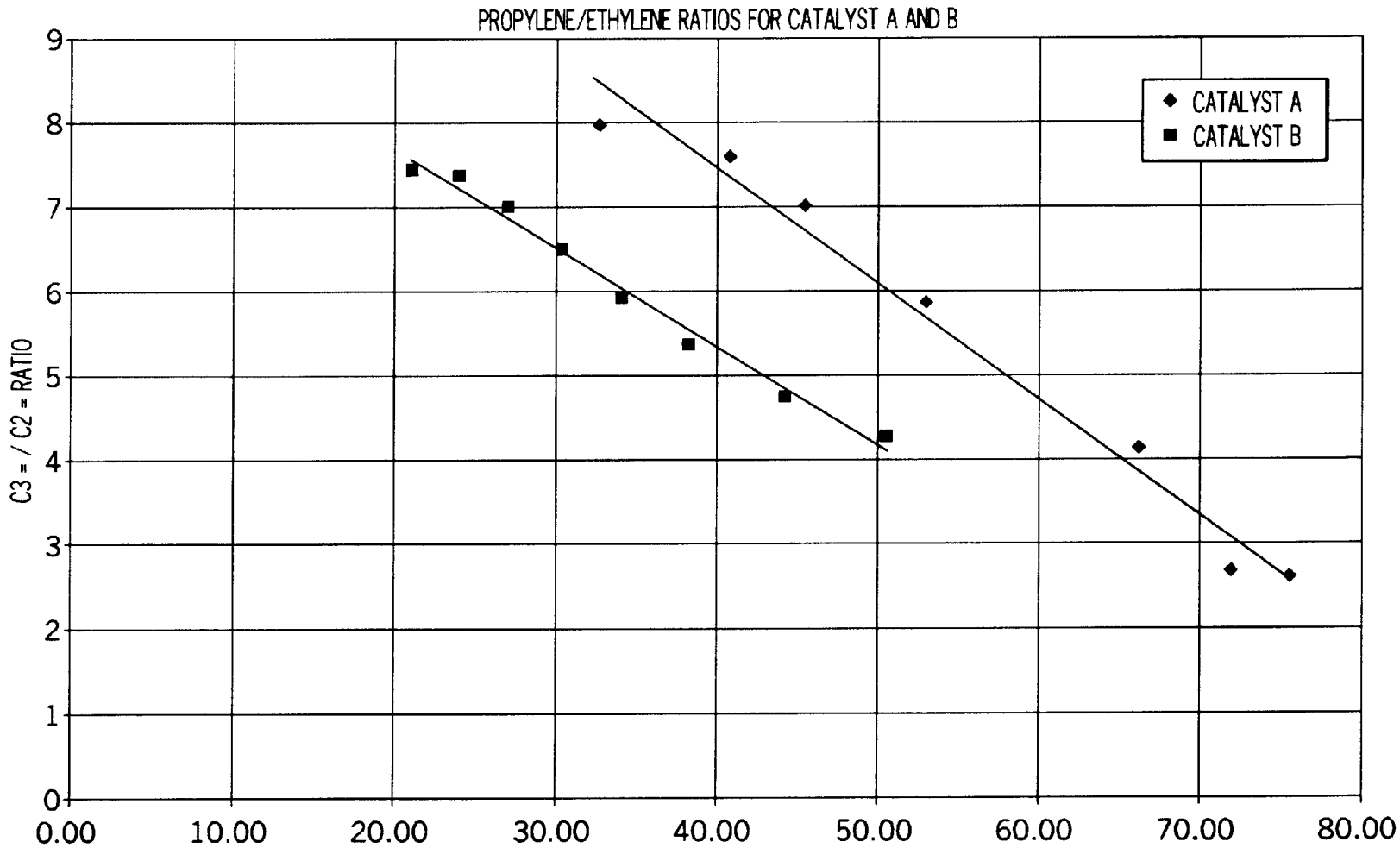

The present invention relates to converting a hydrocarbon feed to produce hydrocarbon compounds containing light olefins, especially propylene and ethylene. In particular, the present invention relates to conversion of a hydrocarbon stream containing $C_4$–$C_7$ olefins and/or paraffins and includes use of an intermediate pore zeolite.

Gasoline is the traditional high value product of fluid catalytic cracking (FCC). Currently however, the demand for ethylene and propylene is growing faster than gasoline and the olefins have higher value per pound than does gasoline. In conventional fluid catalytic cracking, typically less than 2 wt. % ethylene in dry gas is obtained, and it is used as fuel gas. The propylene yield is typically 3–6 wt. %.

Catalytic cracking operations are commercially employed in the petroleum refining industry to produce useful products, such as high quality gasoline and fuel oils from hydrocarbon-containing feeds. The endothermic catalytic cracking of hydrocarbons is most commonly practiced using Fluid Catalytic Cracking (FCC) and moving bed catalytic cracking, such as Thermofor Catalytic Cracking (TCC). In FCC, a cyclic mode is utilized and catalyst circulates between a cracking reactor and a catalyst regenerator. In the cracking reactor, hydrocarbon feedstock is contacted with hot, active, solid particulate catalyst without added hydrogen, for example at pressures up to 50 psig (4.4 bar) and temperatures of about 425° C. to 600° C. As the hydrocarbon feed is cracked to form more valuable products, carbonaceous residue known as coke is deposited on the catalyst, thereby deactivating the catalyst. The cracked products are separated from the coked catalyst, the coked catalyst is stripped of volatiles, usually with steam in a catalyst stripper, and the catalyst is then regenerated. Decoking restores catalyst activity while the burning of the coke heats the catalyst. The heated, regenerated catalyst is recycled to the cracking reactor to crack more feed.

In order to produce higher yields of light olefins, e.g. propylene and butylene, in conventional FCC reactors, the trend has been to dilute phase riser cracking with a brief hydrocarbon feed residence time of one to ten seconds. In such methods, a small amount of diluent, e.g., steam up to 5 wt. % of the feed, is often added to the feed at the bottom of the riser. Dense bed or moving bed cracking can also be used with a hydrocarbon residence time of about 10 to 60 seconds. The FCC process generally uses conventional cracking catalyst which includes large pore zeolite such as USY or REY. A minor amount of ZSM-5 has also been used as an additive to increase FCC gasoline octane. Commercial units are believed to operate with less than 10 wt. % additive, usually considerably less.

U.S. Pat. No. 5,389,232 to Adewuyi et al. describes an FCC process in which the catalyst contains up to 90 wt. % conventional large pore cracking catalyst and an additive containing more than 3.0 wt. % ZSM-5 on a pure crystal basis on an amorphous support. The patent indicates that although ZSM-5 increases $C_3$ and $C_4$ olefins, high temperatures degrade the effectiveness of the ZSM-5. Therefore, a temperature of 950° F. to 1100° F. (510° C. to 593° C.) in the base of the riser is quenched with light cycle oil downstream of the base to lower the temperature in the riser 10° F.–100° F. (5.6° C.–55.6° C.). The ZSM-5 and the quench increase the production of $C_3/C_4$ light olefins but there is no appreciable ethylene product.

U.S. Pat. No. 5,456,821 to Absil et al. describes catalytic cracking over a catalyst composition which includes large pore molecular sieve, e.g., USY, REY or REUSY, and an additive of ZSM-5, in an inorganic oxide binder, e.g., colloidal silica with optional peptidized alumina, and clay. The clay, a source of phosphorus, zeolite and inorganic oxide are slurried together and spray-dried. The catalyst can also contain metal such as platinum as an oxidation promoter. The patent teaches that an active matrix material enhances the conversion. The cracking products included gasoline, and $C_3$ and $C_4$ olefins but no appreciable ethylene.

European Patent Specifications 490,435-B and 372,632-B and European Patent Application 385,538-A describe processes for converting hydrocarbonaceous feedstocks to olefins and gasoline using fixed or moving beds. The catalysts included ZSM-5 in a matrix which included a large proportion of alumina.

Although modifying conventional FCC processes to increase light olefin production can increase the yield of ethylene and especially propylene, increasing petrochemical propylene recovery from refinery FCC's competes with alkylation demand. Moreover, the addition of additives such as ZSM-5 to the FCC reactor to increase propylene production, not only lowers gasoline yields, but may affect gasoline quality. Thus, many of the proposed modifications to a conventional FCC process will have undesirable effects on motor fuel quality and supply, resulting in the need for additional processing or blending to achieve acceptable motor fuel quality.

Thus, it would be advantageous to upgrade low value refinery streams to ethylene and propylene, while continuing to produce high quality motor fuels via conventional FCC processes.

In that regard, other types of processes have been developed for producing olefins from feeds not typically utilized in FCC processes which produce motor fuels. Processes for producing olefins from paraffinic feeds such as intermediate distillate, raffinate, naphtha and naphthenes, with olefin production directly or indirectly, are described, for example, in U.S. Pat. Nos. 4,502,945 to Olbrich et al., 4,918,256 to Nemet-Mavrodin, 5,171,921 to Gaffney et al., 5,292,976 to Dessau et al., and EP 347,003-B. The paraffinic feeds do not contain any significant amount of aromatics. These processes differ not only in feed, but in process conditions, variously including, for example, a requirement for addition of hydrogen (hydrocracking), use of high space velocities, accepting low conversions per pass, use of acidic or high alumina zeolites and use of alumina binders or other active binders for the catalysts. In addition, little coke is produced on the catalyst in connection with many of these processes so that fuel gas must be burned to generate heat for the endothermic reaction.

U.S. Pat. No. 4,980,053 to Li et al. describes catalytic cracking (deep catalytic cracking) of a wide range of hydrocarbon feedstocks. Catalysts include pentasil shaped molecular sieves and Y zeolites. Although the composition of the pentasil shape selective molecular sieve (CHP) is not particularly described, a table at column 3 indicates that the pentasil catalyst contains a high proportion of alumina, i.e., 50% alumina, presumably as a matrix. Deep Catalytic Cracking (DCC) is discussed by L. Chapin et al., "Deep Catalytic Cracking Maximizes Olefin Production", as presented at the 1994 National Petroleum Refiners Association Meeting. Using a catalyst of unspecified composition, the process produces light olefins of $C_3$–$C_5$ from heavy feedstocks. See also, Fu et al., Oil and Gas Journal, Jan. 12, 1998, pp 49–53.

It is an object of the invention to provide a catalytic conversion process with increased yield of $C_2$ and $C_3$ olefins from low value refinery, petrochemical or other chemical synthesis streams.

SUMMARY OF THE INVENTION

The invention includes a process for converting a hydrocarbon feed containing $C_4$ to $C_7$ olefins and/or paraffins to hydrocarbon products containing light olefins by contacting the feed with a catalyst which comprises zeolite ZSM-5 and/or ZSM-11, having an initial silica/alumina ratio greater than about 300 for the fresh catalyst, and phosphorus. The contacting is under conditions to produce light olefin product comprising ethylene and propylene.

In an embodiment of the present invention, the catalyst will be incorporated with a binder or matrix material resistant to the temperature and other conditions employed in the process. Such matrix materials can include synthetic or naturally occurring zeolites, as well as inorganic materials such as clays, silica and/or metal oxides.

The conversion conditions of the present invention minimize hydrogen transfer and it is preferred to avoid hydrogen addition, hydroprocessing and the use of other catalyst components which would introduce excess hydrogen transfer activity. It has also been discovered that in light of the selective activity of the catalyst, the process can be conducted at generally higher temperatures than conventional, commercially practiced fluid catalytic cracking, resulting in an increase in the rate of conversion to desired products, e.g. propylene and ethylene. Catalytic conversion conditions include a temperature from about 950° F. (510° C.) to about 1300° F. (704° C.), a pressure from sub-atmospheric to about 115 psia (8 bar), a catalyst/oil ratio from about 0.1 to about 10, and a WHSV from about 1 to about 20 $hr^{-1}$. In order to provide heat for the endothermic reaction, the catalyst is preferably hot, regenerated catalyst such as may be obtained by continuously circulating from the regenerator.

The products of the catalytic conversion process include light olefins, e.g. propylene and ethylene, and less than about 5 wt % propane plus ethane. The product light olefins can include ethylene plus propylene in an amount of at least 20 wt. % based on total product; or at least 25 wt. %, and even up to 30 wt. % or more ethylene plus propylene. The product light olefins contain a significant amount of propylene relative to ethylene, with a propylene/ethylene weight ratio greater than about 3.0.

The process can be practiced in a fluid bed reactor, fixed bed reactor, multiple-fixed bed reactor (e.g. a swing reactor), batch reactor, a fluid catalytic cracking (FCC) reactor or a moving bed catalytic cracking reactor such as used in Thermophore Catalytic Cracking (TCC). A dense fluid bed reactor is preferred. A hydrocarbon feed containing $C_4$–$C_7$ olefins and/or paraffins is catalytically converted in a catalytic reactor (e.g. a fluid bed reactor) operating under reaction conditions by contacting the feed with a catalyst containing ZSM-5 and/or ZSM-11 , having an initial silica to alumina ratio greater than 300 for the fresh catalyst, and phosphorus, the contacting producing a product effluent which includes light olefins. During the reaction, coke is formed on the catalyst. The product effluent and the catalyst containing coke are separated from each other. The effluent is recovered and the catalyst containing coke is regenerated by contact with oxygen-containing gas to burn off the coke and produce hot, regenerated catalyst and to produce heat for the endothermic reaction. The hot, regenerated catalyst is recycled to the catalytic reactor.

Advantageously, the process produces valuable light olefins useful as petrochemical feedstocks with a high propylene to ethylene ratio, a high purity propylene product, low conversion to aromatics, and low dry gas (e.g. hydrogen and methane) yield.

DETAILED DESCRIPTION OF THE INVENTION

In accordance with the present invention, a hydrocarbon feed containing $C_4$–$C_7$ olefins and/or paraffins is converted to more valuable light olefins. The present process provides not only significantly more ethylene plus propylene, over conventional processes, but provides a product with a propylene/ethylene ratio greater than 3.0. Typically, modifications to conventional FCC processes to improve propylene yield result in an increase in propane yield as well. However, since the catalyst of the invention has different activity characteristics than conventional FCC catalysts, the process is conducive to high temperature operation without the formation of significant propane. Thus, a relatively high purity propylene of at least 80 wt % based on the $C_3$ fraction of the product, or at least 85 wt %, and even up to 90 wt % or greater, can be achieved. Additionally, only a relatively small amount of aromatics, e.g. benzene, toluene and xylene (BTX), is produced with a $(C_{2=}+C_{3=})$/BTX weight ratio greater than 3.5, based upon the net increase in $C_{2=}$, $C_{3=}$ and BTX relative to the feed. Thus, while it is not intended to be bound by theory, it is believed that propylene and ethylene can be produced catalytically from a hydrocarbon feed containing $C_4$–$C_7$ olefins and/or paraffins without significant production of propane or ethane and without significant production of aromatics, e.g. BTX.

FEEDS

The hydrocarbon feed stream of this invention will typically be low value refinery or petrochemical streams, such as steam cracker by-products rich in $C_4$'s and pygas, which have poor propylene selectivity when recycled to the steam cracker. The feed stream contains at least 30%, and preferably 50%, by weight of aliphatic hydrocarbon(s) containing 4 to 7 carbon atoms. The hydrocarbon can be straight chain, open chain or cyclic and can be saturated or unsaturated. Some contemplated hydrocarbons are n-butane, n-butenes, isobutane, isobutene, straight chain, branched chain and cyclic, pentanes, pentenes, hexanes, hexenes, heptanes and heptenes.

The hydrocarbon feed stream of the invention can include light naphthas or raffinates, containing sufficient amounts of $C_4$–$C_7$ olefins and/or paraffins, $C_4$–$C_7$ cuts from light naphthas or raffinates, catalytic cracked naphtha, coker naphtha, steam cracker pyrolysis gasoline, synthetic chemical streams containing sufficient amounts of $C_4$–$C_7$ olefins and/or paraffins or any other hydrocarbons containing sufficient amounts of $C_4$–$C_7$ olefins and/or paraffins. Feeds containing high levels of dienes, sulfur, nitrogen and oxygenates are preferably selectively hydrotreated prior to employing the conversion process. However, appropriate feeds with low levels of dienes, sulfur, nitrogen, metal compounds and oxygenates can be processed directly from FCC units, cokers or steam crackers without any pretreatment.

PROCESS

Catalytic conversion units which are amenable to the invention can operate at temperatures from about 950° F. (510° C.) to about 1300° F. (704° C.) preferably from about 1000° F. (510° C.) to about 1200° F. (649° C.) and under sub-atmospheric to superatmospheric total pressure, usually from about 2 to 115 psia (0.1 to 8 bar), preferably from about 15 to 65 psia (1 to 4.5 bar). Because the catalyst used in the invention has different cracking activity relative to conventional FCC catalysts, a higher temperature as compared with conventional FCC may be utilized to achieve a higher conversion to the desired light olefins.

The catalytic process can be either fixed bed, moving bed, transfer line, or fluidized bed, and the hydrocarbon flow can be either concurrent or countercurrent to the catalyst flow. The process of the invention is particularly applicable to a dense fluidized bed process. In this process, the hydrocarbon feed containing the $C_4$–$C_7$ olefins and/or paraffins is continuously passed through a fluidized bed under conversion conditions in the presence of the catalyst and the catalyst is continuously circulated between the fluidized bed and a regenerator.

In a fluidized bed conversion process, the fluidizable catalyst is made up of fine solid particles having a size range of about I to about 150 micrometers and an average catalyst particle size of about 20 to 100 micrometers. This catalyst is generally suspended or fluidized by the feed. Diluent such as steam or an inert gas can be added to the feed at the bottom of the fluidized bed reactor to lower hydrocarbon partial pressure and assist in fluidizing the bed. A hydrocarbon feedstock containing $C_4$–$C_7$ olefins and/or paraffins is admixed with a suitable catalyst to provide a fluidized suspension and converted in a fluidized bed reactor at elevated temperatures to provide a product mixture containing light olefins. The gaseous reaction products are discharged from the reactor and conveyed to a product recovery zone. Spent catalyst is continuously withdrawn from the fluidized bed reactor and conveyed to a regenerator. In order to remove entrained hydrocarbons from the spent catalyst, prior to conveying the latter to a catalyst regenerator unit, the catalyst may optionally be conveyed to a dense catalyst bed within a stripping vessel where an inert stripping gas, e.g., steam, is passed through the catalyst bed to desorb such hydrocarbons conveying them to the product recovery zone. The spent catalyst includes deposited coke which is burned off in an oxygen-containing atmosphere in a regenerator to produce hot, regenerated catalyst. The fluidizable catalyst is continuously circulated between the fluidized bed and the regenerator and serves to transfer heat from the latter to the former thereby helping to supply some of the thermal needs of the conversion reaction which is endothermic. The dense fluid bed conversion conditions preferably include a temperature from about 950° F. (510° C.) to about 1250° F. (677° C.), more preferably 1000° F. (538° C.) to about 1200° F. (649° C.); catalyst/oil weight ratio from about 0.1 to about 10, and a weight hourly space velocity (WHSV) of about 1 to 20 $hr^{-1,}$ preferably about 1 to 10 $hr^{-1}$.

CATALYST

The catalyst composition includes zeolite ZSM-5 (U.S. Pat. No. 3,702,886 and Reissue Pat. No. 29,948) and/or ZSM-11 (U.S. Pat. No. 3,709,979). While previously, large pore zeolite with ZSM-5 additive were used in fluid catalytic cracking, the present invention uses only ZSM-5 and/or ZSM-11 without large pore zeolite. Preferably, relatively high silica ZSM-5 and/or ZSM- 11 zeolite is used, i.e., ZSM-5 and/or ZSM- 11 with an initial silica/alumina molar ratio above 300 for the fresh zeolite, and more preferably with a ratio of 400, 450 or higher. This ratio is meant to represent, as closely as possible, the molar ratio in the rigid framework of the zeolite crystal and to exclude silicon and aluminum in the matrix or in cationic or other form within the channels. Other metals besides aluminum have been incorporated into the zeolite framework such as gallium which can be used in the invention.

The preparation of the zeolite may require reduction of the sodium content, as well as conversion to the protonated form. This can be accomplished, for example by employing the procedure of converting the zeolite to an intermediate ammonium form as a result of ammonium ion exchange followed by calcination to provide the hydrogen form. The operational requirements of these procedures are well known in the art. The source of the ammonium ion is not critical; thus the source can be ammonium hydroxide or an ammonium salt such as ammonium nitrate, ammonium sulfate, ammonium chloride and mixtures thereof. These reagents are usually in aqueous solutions. By way of illustration, aqueous solutions of 1N $NH_4OH$, 1N $NH_4$ *and* 1N $NH_4Cl/NH_4OH$ have been used to effect ammonium ion exchange. The pH of the ion exchange is not critical but is generally maintained at 7 to 12. Ammonium exchange may be conducted for a period of time ranging from about 0.5 to about 20 hours at a temperature ranging from ambient up to about 100° C. The ion exchange may be conducted in single stage or in multiple stages. Calcination of the ammonium exchanged zeolite will produce its hydrogen form. Calcination can be effected at temperatures up to about 550° C.

The catalyst composition is also combined with a modifier which contains phosphorus. Incorporation of such a modifier in the catalyst of the invention is conveniently achieved by the methods described in U.S. Pat. Nos. 3,911,041 to Kaeding et al., 3,972,832 to Butter et al., 4,423,266 to Young et al., 4,590,321 to Chu, 5,110,776 to Chitnis et al., and 5,231,064, 5,348,643 and 5,456,821 to Absil et al., the entire disclosures of which are incorporated herein by reference. Treatment with phosphorus-containing compounds can readily be accomplished by contacting the zeolite ZSM-5 and/or ZSM- 11, either alone or in combination with a binder or matrix material, with a solution of an appropriate phosphorus compound, followed by drying and calcining to convert the phosphorus to its oxide form. Contact with the phosphorus-containing compound is generally conducted at a temperature in the range of about 25° C. to about 125° C. for a time between about 15 minutes and about 20 hours. The concentration of the phosphorus in the contact mixture may be between about 0.01 and about 30 wt. %.

After contacting with the phosphorus-containing compound, the catalyst material may be dried and calcined to convert the phosphorus to an oxide form. Calcination can be carried out in an inert atmosphere or in the presence of oxygen, for example, in air at a temperature of about 150 to 750° C., preferably about 300 to 500° C., and typically about 0.5–5 hours.

For use in catalytic conversion processes a zeolite is usually compounded with a binder or matrix material for increased resistance to temperatures and other conditions, e.g., mechanical attrition, which occur in various hydrocarbon conversion processes such as cracking. It is generally necessary that the catalysts be resistant to mechanical attrition, that is, the formation of fines which are small particles, e.g., less than 20 micrometer. The cycles of reacting and regeneration at high flow rates and temperatures, such as in a fluidized bed process, have a tendency to break down the catalyst into fines, as compared with an average diameter of catalyst particles. In a fluidized catalyst process, catalyst particles range from about 1 to about 150 micrometers, and preferably an average catalyst particle size from about 20 to about 100 micrometers. Excessive generation of catalyst fines increases catalyst cost and can cause problems in fluidization and solids flow.

Useful matrix materials include active and inactive materials and synthetic or naturally occurring zeolites as well as inorganic materials such as clays, silica and/or metal oxides. The latter may be either naturally occurring or in the form of gelatinous precipitates, sols or gels including mixtures of silica and metal oxides. Use of a material in conjunction with the above-described catalysts, i.e., combined therewith, which is active, may be useful in improving the conversion and/or selectivity of the catalyst. Inactive materials may suitably serve as diluents to control the amount of conversion and/or selectivity of the catalyst. Frequently, zeolite or other crystalline materials have been incorporated into naturally occurring clays, e.g., bentonite and kaolin. These materials, i.e., clays, oxides, etc., function, in part, as binders for the catalyst. It is desirable to provide a catalyst having good attrition resistance, because in practice the catalyst is often subject to rough handling, which tends to break the catalyst down into powder-like materials which can cause problems in fluidization and solids handling.

The matrix can comprise up to 100% by weight clay. Naturally occurring clays which can be composited with the catalyst include the montmorillonite and kaolin families which include the subbentonites, and the kaolins commonly known as Dixie, McNamee, Georgia and Florida clays or others in which the main mineral constituent is halloysite, kaolinite, dickite, macrite or anauxite. Such clays can be used in the raw state as originally mined or initially subjected to calcination, acid treatment or chemical modification. Clay is generally used as a filler to produce denser catalyst particles.

In addition to the foregoing materials, the above-described catalysts can be composited with a porous matrix material such as silica, alumina, zirconia, titania, silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. The matrix can be in the form of a cogel. A mixture of these components could also be used.

In general, the relative proportions of finely divided, crystalline zeolite component and matrix can vary widely, with the zeolite ZSM-5 and/or ZSM-11 content ranging from about 1 to about 90 percent by weight, and more usually from about 2 to about 80 weight percent of the composite. Preferably, the zeolite ZSM-5 and/or ZSM-11 makes up about 5 to about 75 wt. % of the catalyst and the matrix makes up about 95 to about 25 wt. % of the catalyst.

The catalyst containing the zeolite ZSM-5 and/or ZSM-11, and a binder (e.g. clay), can be prepared in fluid form by combining a zeolite ZSM-5 and/or ZSM-11 slurry with a clay slurry. Phosphorus can be incorporated by any of the methods known in the art, as discussed more fully above. The catalyst can then be spray dried. Optionally, the spray dried catalyst can be calcined in air or an inert gas and steamed under conditions well known in the art to adjust the initial acid-catalyzed activity of the catalyst.

In an embodiment of the present invention, the catalyst composition may include metals useful in promoting the oxidation of carbon monoxide to carbon dioxide under catalyst regeneration conditions as described in U.S. Pat. Nos. 4,072,600 and 4,350,614, the entire contents of each incorporated herein by reference. Examples of this embodiment include addition to the catalyst composition for use herein trace amounts of oxidation promoter selected from the group consisting of platinum, palladium, iridium, osmium, rhodium, ruthenium, rhenium, and combination thereof. The catalyst composition may comprise, for example, from about 0.01 ppm to about 100 ppm by weight oxidation promoter, usually from about 0.01 ppm to about 50 ppm by weight, preferably from about 0.01 ppm to about 5 ppm by weight.

PRODUCTS

The products of the catalytic conversion process include light olefins, e.g. propylene and ethylene. Preferably, a higher yield of propylene is produced than is usually obtained in conventional catalytic cracking processes utilizing a ZSM-5 additive. The product includes a propylene/ethylene weight ratio greater than about 3.0 based upon weight percentages of the product yields based on total feed. A substantial amount of ethylene is also produced, so that the amount of ethylene plus propylene is preferably greater than about 20 wt. %, preferably greater than about 25 wt. %, more preferably greater than 30 wt. % as a percentage of the product based on total feed. The product can include less than about 10 wt. %, and preferably less than about 5 wt. % ethane plus propane. Thus, a relatively high purity propylene of at least 80 wt % based on the $C_3$ fraction of the conversion products, or at least 85 wt %, and even up to 90 wt % or greater, is achieved. Additionally, only a relatively small amount of aromatics, e.g. benzene, toluene and xylene (BTX), is produced with a $(C_{2=}+C_{3=})$/BTX weight ratio greater than 3.5, based on the net increase of $C_{2=}$, $C_{3=}$ and BTX relative to the feed.

The hydrocarbon conversion based on feed olefins is from about 20% to about 90%, preferably 40% to 80%. The amount of coke produced generally increases with conversion conditions.

The following non-limiting examples illustrate the invention. These examples include the preparation and use of a catalyst according to the invention to convert both a 1-butene and a $C_5$–$C_7$ cut of a light catalytic naphtha (LCN) feed to light olefins, the preparation and use of two other catalysts in comparative examples and a comparison of the catalyst according to the invention with one of the comparative catalysts to evaluate the selectivity for each catalyst to propylene at different feed olefin conversions.

EXAMPLE 1

A phosphorous containing ZSM-5 catalyst, Catalyst A, was prepared which contains about 38 wt % ZSM-5, having a $SiO_2/Al_2O_3$ ratio of 450:1, about 58 wt % kaolin clay binder and about 4 wt % phosphorous. A slurry was prepared by combining approximately 40.8 parts of zeolite with 140.5 parts of water and thoroughly mixed. To the slurry was added 17.2 parts of concentrated $H_3PO_4$ and thoroughly mixed. A second slurry was prepared by combining approximately 63.5 parts of clay and 24.2 parts of water and thoroughly mixed. The clay slurry was added to the ZSM-5/phosphoric acid slurry and mixed thoroughly for 15 min. The mixed slurry was then spray dried. The spray dried catalyst was calcined in air at 1150° F. (621° C.) for 45 minutes and then subjected to cyclic propylene steaming (CPS) at 1435° F. (779° C.) for 20 hours at 35 psig (3.4 bar) to simulate equilibrated catalyst. The equilibrium catalyst or Ecat in a fluid bed process is generated by continuous circulation between reaction and regeneration environments and the rate of make-up/withdrawal of fresh/aged catalyst. The CPS procedure consisted of exposing the catalyst to the following cyclic environment: (1) 50 vol % steam and the balance nitrogen for 10 min., (2) 50 vol % steam and the balance containing a mixture of 5% propylene and 95% nitrogen for 10 min., (3) 50 vol % steam and the balance nitrogen for 10 min. and (4) 50 vol % steam and the balance air for 10 min.

The formed catalyst, Catalyst A, was utilized in a bench-scale fluid bed reactor as follows: 15 grams of catalyst were loaded into the reactor. The reactor was maintained at a temperature of about 1000 to 1100° F. (538–593° C.) and a feed of 1-butene was introduced into the reactor under a total system pressure of 8 psig (1.6 bar). The flow rate of the feed, expressed as weight hourly space velocity (WHSV) was maintained at about 3.1 $hr^{-1}$.

Products from the reactor were separated into a gas and liquid product and analyzed using standard GC techniques. The selectivity to propylene in the product was found to be 29.3 wt % after 2 hours of operation and 43.5 wt % after 11.0 hours of operation. Product selectivity is defined as mass of product produced per mass of feed converted. The $C_{3=}/C_{2=}$ ratio in the product was greater than 3 and the propylene purity, based upon the total $C_3$ fraction of the product, was greater than 90 wt %.

The process conditions, conversion of feed and products are listed below in Table 1.

Example 1 reveals that when a feed of 1-butene was delivered to a fluid bed reactor containing Catalyst A, under conversion conditions, there was a relatively high selectivity to propylene without significant production of propane or BTX.

EXAMPLE 2

As a comparative example, a phosphorus containing ZSM-5 catalyst, Catalyst B, was evaluated which contains about 25 wt % ZSM-5, having an initial $SiO_2/A1_2O_3$ ratio of 26:1, about 73.6 wt % binder containing silica-alumina and clay, and about 1.4 wt % phosphorus. Catalyst B was prepared in fluid form similar to Catalyst A from Example 1. However, after spray drying and calcination, Catalyst B was steamed at 1200° F. (649° C.) for 8 hours in 100% steam at 0 psig (1 bar).

A 15 gram sample of Catalyst B was loaded into the bench-scale fluid bed reactor and contacted with a 1-butene feed at conditions similar to Example 1.

The products were analyzed using standard GC techniques. The selectivity to propylene in the product was found to be 16.9 wt % after 2 hrs of operation and 36.9 wt % after 11.5 hours of is operation. The $C_3=/C_2=$ratio was generally below 3, except after 11.5 hours of operation when the WHSV was increased. The propylene purity never exceeded 90 wt %.

The process conditions, conversion of feed and products are listed below in Table 1.

Example 2 reveals that the use Catalyst B results in lower selectivity to propylene, with a lower purity propylene, than that achieved by the use of Catalyst A. Moreover the use Catalyst B resulted in increased production of BTX, compared with Catalyst A.

TABLE 1

| | Example 1 | | | | Example 2 | | | |
|---|---|---|---|---|---|---|---|---|
| Catalyst | A | A | A | A | B | B | B | B |
| Hours on Stream | 2.0 | 5.0 | 8.0 | 11.0 | 2.0 | 5.0 | 8.0 | 11.5 |
| Temperature, ° F./° C. | 998/537 | 1051/566 | 1100/593 | 1099/543 | 998/537 | 1052/566 | 1102/593 | 1102/593 |
| Pressure, psig/bar | 8/1.6 | 8/1.6 | 8/1.6 | 8/1.6 | 8/1.6 | 8/1.6 | 8/1.6 | 8/1.6 |
| WHSV | 3.1 | 3.1 | 3.1 | 3.1 | 3.1 | 3.1 | 3.1 | 5.2 |
| Feed Olefin PP, psia/bar | 22.7/1.6 | 22.7/1.6 | 22.7/1.6 | 22.7/1.6 | 22.7/1.6 | 22.7/1.6 | 22.7/1.6 | 22.7/1.6 |
| Butene Conversion % | 78.6 | 76.8 | 73.9 | 71.6 | 88.7 | 84.5 | 80.8 | 73.9 |
| Selectivity on Converted Butene, wt % | | | | | | | | |
| $C_2$ = | 6.8 | 7.8 | 8.4 | 7.8 | 7.9 | 10.8 | 13.1 | 11.5 |
| $C_3$ = | 29.3 | 35.2 | 41.8 | 43.5 | 16.9 | 25.4 | 32.9 | 36.9 |
| Benzene | 1.4 | 1.4 | 1.3 | 1.9 | 3.3 | 3.1 | 2.9 | 2.4 |
| Toluene | 2.9 | 2.8 | 3.5 | 3.8 | 8.7 | 7.5 | 6.4 | 4.9 |
| $C_8$ Aromatics | 3.2 | 2.5 | 3.7 | 3.8 | 8.8 | 7.6 | 5.7 | 4.5 |
| Product Ratios | | | | | | | | |
| $C_3$ =/$C_2$ = (wt/wt) | 4.3 | 4.5 | 5.0 | 5.6 | 2.1 | 2.3 | 2.5 | 3.2 |
| ($C_2$ = +$C_3$ =)/BTX (wt/wt) | 4.8 | 6.4 | 5.9 | 5.4 | 1.2 | 2.0 | 3.1 | 4.1 |
| $C_2$ = Purity, % | 94 | 92 | 86 | 84 | 80 | 83 | 83 | 87 |
| $C_3$ = Purity % | 90 | 92 | 93 | 94 | 48 | 69 | 81 | 87 |
| Product, wt % | | | | | | | | |
| Hydrogen | 0.05 | 0.06 | 0.10 | 0.10 | 0.17 | 0.14 | 0.15 | 0.09 |
| Methane | 0.34 | 0.65 | 1.71 | 1.83 | 0.80 | 0.95 | 1.43 | 0.92 |
| Ethane | 0.33 | 0.52 | 0.99 | 1.02 | 1.79 | 1.80 | 2.17 | 1.30 |
| Ethene | 5.34 | 5.98 | 6.24 | 5.58 | 6.99 | 9.13 | 10.57 | 8.48 |
| Propane | 2.60 | 2.30 | 2.15 | 2.03 | 15.98 | 9.50 | 6.39 | 4.20 |
| Propene | 23.00 | 27.02 | 30.90 | 31.16 | 14.98 | 21.42 | 26.61 | 27.29 |
| n-Butane | 2.55 | 2.37 | 2.10 | 2.03 | 5.93 | 4.26 | 3.13 | 2.70 |
| I-Butane | 2.24 | 1.71 | 1.31 | 1.22 | 6.90 | 4.15 | 2.51 | 1.95 |
| Butenes | 21.38 | 23.15 | 26.10 | 28.43 | 11.26 | 15.52 | 19.22 | 26.09 |
| n-Pentane | 0.39 | 0.30 | 0.20 | 0.18 | 0.93 | 0.63 | 0.34 | 0.28 |
| I-Pentane | 0.80 | 0.58 | 0.38 | 0.34 | 1.93 | 1.11 | 0.51 | 0.40 |
| Pentenes | 9.04 | 9.22 | 7.44 | 7.85 | 4.46 | 5.94 | 5.90 | 7.72 |
| $C_5$-Naph | 0.16 | 0.27 | 0.25 | 0.27 | 0.34 | 0.38 | 0.35 | 0.34 |
| n-$C_6$ | 0.12 | 0.09 | 0.05 | 0.04 | 0.12 | 0.11 | 0.06 | 0.06 |
| m-$C_5$ | 0.20 | 0.12 | 0.06 | 0.04 | 0.37 | 0.21 | 0.09 | 0.08 |
| dm-$C_4$ | 0.08 | 0.00 | 0.16 | 0.06 | 0.05 | 0.05 | 0.03 | 0.04 |
| $C_6$ Olefins | 2.43 | 1.91 | 0.74 | 0.54 | 1.07 | 1.34 | 1.12 | 1.30 |

TABLE 1-continued

| | Example 1 | | | | Example 2 | | | |
|---|---|---|---|---|---|---|---|---|
| Catalyst | A | A | A | A | B | B | B | B |
| $C_6$-Naph | 0.65 | 0.31 | 0.18 | 0.15 | 0.70 | 0.60 | 0.40 | 0.33 |
| Benzene | 1.11 | 1.07 | 0.98 | 1.37 | 2.91 | 2.61 | 2.36 | 1.81 |
| n-$C_7$ | 0.15 | 0.15 | 0.08 | 0.07 | 0.07 | 0.06 | 0.06 | 0.06 |
| m-$C_6$ | 0.11 | 0.08 | 0.04 | 0.02 | 0.09 | 0.05 | 0.04 | 0.03 |
| dm-$C_5$ | 0.51 | 0.41 | 0.18 | 0.08 | 0.15 | 0.17 | 0.13 | 0.21 |
| $C_7$ Olefins | 4.72 | 4.08 | 2.47 | 1.44 | 1.30 | 1.54 | 1.44 | 1.95 |
| $C_7$-Naph | 0.11 | 0.10 | 0.04 | 0.03 | 0.08 | 0.08 | 0.05 | 0.05 |
| Toluene | 2.26 | 2.12 | 2.62 | 2.71 | 7.76 | 6.35 | 5.19 | 3.59 |
| $C_8$ Par | 0.22 | 0.20 | 0.13 | 0.12 | 0.10 | 0.08 | 0.06 | 0.05 |
| $C_8$ Olefins | 1.84 | 1.27 | 0.37 | 0.44 | 0.09 | 0.18 | 0.14 | 0.20 |
| $C_8$-Naph | 2.39 | 2.26 | 1.88 | 1.35 | 0.69 | 0.78 | 0.81 | 1.00 |
| Ethylbenzene | 0.74 | 0.58 | 0.47 | 0.49 | 0.88 | 0.75 | 0.55 | 0.46 |
| Xylenes | 1.79 | 1.34 | 2.24 | 2.24 | 6.89 | 5.66 | 4.04 | 2.86 |
| $C_9$+ | 12.35 | 9.79 | 7.48 | 6.73 | 4.23 | 4.42 | 4.13 | 4.15 |
| TOTAL | 100.0 | 100.0 | 100.0 | 100.0 | 100.00 | 100.0 | 100.0 | 100.0 |

EXAMPLE 3

As a comparative example, a ZSM-5 catalyst, Catalyst C, was evaluated which contains about 25 wt % ZSM-5, having an initial $SiO_2/A1_2O_3$ ratio of 55:1, and about 75 wt % binder containing silica-alumina and clay. Catalyst C was prepared in fluid form similar to Catalyst A from Example 1, except there was no phosphorus added. After spray drying and calcination, the catalyst was steamed at 1 100° F. (593° C.) for 12 hours in a 45/55 vol % steam/air mixture at 0 psig (1 bar).

A 15 gram sample of Catalyst C was loaded into the bench-scale fluid bed reactor and contacted with a $C_5$_$C_7$ cut of light catalytic naphtha (LCN), which contained about 52 wt % olefins. The reaction conditions were maintained at 1100° F. (593° C.) and about 30 psig (3.1 bar) total pressure.

The operating conditions, conversion of feed and products are listed below in Table 2.

EXAMPLE 4

Example 3 was repeated using Catalyst A as follows: a 15 gram sample of Catalyst A was loaded into the bench-scale fluid bed reactor and contacted with the LCN feed from Example 3, under similar conditions.

The operating conditions, conversion of feed and products are listed below in Table 2.

TABLE 2

| | LCN Feed | Ex. 3 | Ex.4 |
|---|---|---|---|
| Catalyst | | C | A |
| Hours on Stream | | 8 | 11 |
| Temperature, ° F. /° C. | | 1100/593 | 1100/593 |
| Pressure, psig/bar | | 30/3.1 | 29/3.0 |
| WHSV | | 6.0 | 5.9 |
| Conversions, %: | | | |
| $C_5$-$C_7$ Olefins | | 82.5 | 79.2 |
| $C_5$+ | | 46.6 | 41.6 |
| Yields on Total Feed, wt %: | | | |
| $C_2$ = | | 6.5 | 5.1 |
| $C_3$ = | | 17.6 | 18.1 |
| Product Ratios: | | | |
| $C_3$ = /$C_2$ = (wt/wt) | | 2.7 | 3.5 |
| $C_2$ = Purity, % | | 72 | 76 |
| $C_3$ = Purity, % | | 82 | 90 |

TABLE 2-continued

| | LCN Feed | Ex. 3 | Ex.4 |
|---|---|---|---|
| Product, wt %: | | | |
| Hydrogen | 0.00 | 0.14 | 0.09 |
| Methane | 0.00 | 2.66 | 2.02 |
| Ethane | 0.00 | 2.54 | 1.62 |
| Ethene | 0.00 | 6.48 | 5.14 |
| Propane | 0.00 | 3.81 | 2.11 |
| Propene | 0.00 | 17.59 | 18.07 |
| n-Butane | 0.29 | 1.11 | 0.69 |
| I-Butane | 0.05 | 1.03 | 0.60 |
| Butenes | 1.65 | 12.25 | 12.44 |
| n-Pentane | 2.86 | 1.87 | 1.94 |
| I-Pentane | 15.33 | 10.06 | 10.36 |
| Pentenes | 25.56 | 5.67 | 6.83 |
| $C_5$ – Naph | 0.30 | 0.36 | 0.36 |
| n-$C_6$ | 1.28 | 0.78 | 0.87 |
| m-$C_5$ | 9.02 | 5.30 | 5.77 |
| dm-$C_4$ | 1.41 | 0.87 | 0.90 |
| $C_6$ olefins | 15.49 | 1.30 | 1.44 |
| $C_6$ Naph | 2.20 | 1.07 | 1.39 |
| Benzene | 2.09 | 2.52 | 2.27 |
| n-$C_7$ | 0.48 | 0.30 | 0.40 |
| m-$C_6$ | 3.19 | 2.04 | 2.46 |
| dm-$C_5$ | 1.53 | 0.79 | 0.95 |
| $C_7$ Olefins | 7.66 | 1.54 | 1.84 |
| $C_7$ Naph | 0.88 | 0.45 | 0.63 |
| Toluene | 2.77 | 6.12 | 5.61 |
| $C_8$ Par | 1.20 | 0.79 | 1.11 |
| $C_8$ Olefins | 1.85 | 0.83 | 1.38 |
| $C_8$ Naph | 1.25 | 0.81 | 1.08 |
| Ethylbenzene | 0.24 | 0.72 | 0.79 |
| Xylenes | 1.00 | 1.93 | 3.82 |
| $C_9$+ | 0.44 | 6.25 | 5.02 |
| TOTAL | 100.0 | 100.0 | 100.0 |

A review of Table 2 reveals that in addition to higher yield of propylene using Catalyst A, there was significantly higher purity of the propylene produced using Catalyst A, relative to Catalyst C.

EXAMPLE 5

A 2 gram sample of Catalyst A was loaded into a fixed bed down-flow reactor and contacted with 1-butene feed at 1100° F. (593° C.) and a WHSV at $5hr^{-1}$. The conversion of butene decreased as the catalyst aged. A second experiment with a sample of Catalyst B was also run. The product from each test run was analyzed using a GC and the conversion selectivity to ethylene and propylene calculated (Selectivity= mass of product olefin/mass of feed olefin converted). FIG. 1 shows the $C_{3=}/C_{2=}$ratio for each catalyst and demonstrates the unexpected selectivity advantage of Catalyst A for propylene production over a wide range of butene conversion.

While there have been described what are presently believed to be preferred embodiments of the invention, those skilled in the art will realize that changes and modifications may be made thereto without departing from the spirit of the invention and it is intended to claim all such changes and modifications as fully within the true scope of the invention.

We claim:

1. A process for converting hydrocarbon feed which includes $C_4$–$C_7$ olefins and $C_4$–$C_7$ paraffins to a product which includes ethylene and propylene, said process comprising:

contacting said feed with a catalyst which comprises ZSM-5, ZSM-11 zeolites or combination thereof, having an initial silica/alumina ratio greater than 300:1, and phosphorus under sufficient conditions to convert $C_4$–$C_7$ paraffins and $C_4$–$C_7$ olefins in said hydrocarbon feed to ethylene and propylene.

2. The process of claim 1 wherein the zeolite makes up about 5 to 75 wt. % of the catalyst, a matrix material makes up about 25 to about 95 wt. % of the catalyst and the phosphorus is present in an amount of about 0.5 to 10 wt. % of the catalyst.

3. The process of claim 2 wherein the matrix material is selected from the group consisting of silica, alumina, silica-alumina, clay and mixtures thereof.

4. The process of claim 1 wherein said contacting is carried out in a dense fluidized bed reactor or a fixed-bed swing reactor.

5. The process of claim 1 wherein said conditions comprise a temperature from about 950° F. to about 1300° F., a pressure from about 2 to about 115 psia, a catalyst/hydrocarbon feed weight ratio from about 0.1 to about 10, and a WHSV from about 1 to about 20 $hr^{-1}$.

6. The process of claim 1 wherein the product comprises propylene and ethylene, with a $C_3$=/$C_2$=weight ratio greater than 3, and a $C_3$ fraction containing greater than 80 wt. % propylene.

7. The process of claim 5 wherein the product has a ($C_2$=+$C_3$=)/BTX weight ratio greater than 3.5, based upon a net increase in $C_2$=, $C_3$=and BTX relative to the feed.

8. The process of claim 6 wherein the product comprises ethylene plus propylene in an amount greater than 20 wt. % based on total product.

9. The process of claim 6 wherein the product contains less than about 10 wt. % ethane plus propane.

10. The process of claim 1 wherein said contacting of said feed with said catalyst is carried out in a dense fluidized bed reactor under reaction conditions to produce a product effluent comprising propylene and ethylene; and further comprising:

a. separating the effluent and the catalyst, said catalyst containing coke;

b. regenerating the catalyst containing coke by contact with oxygen-containing gas to produce hot, regenerated catalyst; and c. recycling the hot, regenerated catalyst to the fluidized bed reactor.

* * * * *